US007597956B2

(12) United States Patent
Koestner et al.

(10) Patent No.: US 7,597,956 B2
(45) Date of Patent: Oct. 6, 2009

(54) METHOD OF MANUFACTURE OF A POLYMERIC FILM WITH ANTI-BLOCKING PROPERTIES

(75) Inventors: Roland J. Koestner, Penfield, NY (US); Craig T. Mollon, Batavia, NY (US); Timothy C. Schunk, Livonia, NY (US); William J. Gamble, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 813 days.

(21) Appl. No.: 11/046,039

(22) Filed: Jan. 28, 2005

(65) Prior Publication Data

US 2005/0167896 A1 Aug. 4, 2005

Related U.S. Application Data

(63) Continuation-in-part of application No. 11/031,702, filed on Jan. 7, 2005, now abandoned, which is a continuation of application No. 10/104,540, filed on Mar. 22, 2002, now abandoned.

(51) Int. Cl.
*B32B 5/16* (2006.01)
*A61F 13/15* (2006.01)

(52) U.S. Cl. ..... 428/327; 428/219; 428/323

(58) Field of Classification Search ..... None
See application file for complete search history.

(56) References Cited

U.S. PATENT DOCUMENTS 5,279,934 A 1/1994 Smith et al.
5,288,598 A 2/1994 Sterman et al.
5,378,577 A 1/1995 Smith et al.
5,393,589 A 2/1995 Zeller et al.
5,563,226 A 10/1996 Muehlbauer et al.
5,714,245 A * 2/1998 Atherton et al. ..... 428/32.15
5,728,742 A * 3/1998 Staples et al. ..... 521/57
5,750,378 A 5/1998 Goodheart et al.

OTHER PUBLICATIONS

T. Allen, "Particle Size Measurement," 4th Ed., Chapman and Hall (1990).
G. Odian, "Principles of Polymerization," 2nd Ed., Wiley (1981).
W. P. Sorenson and T. W. Campbell, "Preparation Methods of Polymer Chemistry," 2nd Ed., Wiley (1968).
M. Kerker, "The Scattering of Light and Other Electromagnetic Radiation," Academic, NY (1969).
C. F. Bohren and D. R. Hoffman, "Absorption and Scattering of Light by Small Particles," John Wiley and Sons, NY (1984).

* cited by examiner

*Primary Examiner*—Sheeba Ahmed
(74) *Attorney, Agent, or Firm*—J. Lanny Tucker

(57) ABSTRACT

A method of fabricating a polymeric film includes adsorbing an ammonium salt surfactant over a plurality of polymer beads. The method also includes adding the polymer beads to a polymer solution, wherein the ammonium salt surfactant substantially prevents flocculation of the polymer beads. Additionally, a polymeric film includes a plurality of polymer beads each having an outer surface. The polymeric film also includes an ammonium salt surfactant disposed over each of the outer surfaces, wherein the ammonium salt surfactant substantially prevents flocculation of the polymer beads.

11 Claims, 4 Drawing Sheets

| Matte-only suspension: AOT vs Uniquat surfactant | | | | |
|---|---|---|---|---|
| | | | | |
| TAC% | 0.00% | 0.00% | 0.00% | 0.00% |
| MmEd(50:50)% | 0.05% | 0.05% | 0.05% | 0.05% |
| MeCl2/solvent% | 98.86% | 94.86% | 89.86% | 79.86% |
| MeOH/solvent% | 1.00% | 5.00% | 10.00% | 20.00% |
| water/solvent% | 0.14% | 0.14% | 0.14% | 0.14% |
| | | | | |
| Uniquat Floc rate (%T/hr x $10^4$) | 0 | 0 | 0 | 10 |
| AOT Floc rate (%T/hr x $10^4$) | 0 | 0 | 20 | 60 |
| | | | | |

| Matte + TAC suspension: AOT vs Uniquat surfactant | | | | | | |
|---|---|---|---|---|---|---|
| | | | | | | |
| TAC% | 0.40% | 0.40% | 0.40% | 0.40% | 0.40% | 0.40% |
| MmEd(50:50)% | 0.05% | 0.05% | 0.05% | 0.05% | 0.05% | 0.05% |
| MeCl2/solvent% | 94.8% | 92.3% | 89.8% | 94.8% | 92.3% | 89.8% |
| MeOH/solvent% | 5.00% | 7.50% | 10.0% | 5.00% | 7.50% | 10.0% |
| water/solvent% | 0.24% | 0.24% | 0.24% | 0.24% | 0.24% | 0.24% |
| AOT mg/m2 | 1.20 | 1.20 | 1.20 | 0.00 | 0.00 | 0.00 |
| Uniquat mg/m$^2$ | 0.00 | 0.00 | 0.00 | 1.20 | 1.20 | 1.20 |
| | | | | | | |
| Floc rate (%T/hr x 10$^4$) | 0 | 220 | 320 | 0 | 0 | 0 |
| | | | | | | |

| Matte + TAC suspension: Uniquat w or w/o Solsperse 32000 | | | | | | |
|---|---|---|---|---|---|---|
| | | | | | | |
| TAC% | 0.40% | 0.40% | 0.40% | 0.40% | 0.40% | 0.40% |
| MmEd(50:50)% | 0.05% | 0.05% | 0.05% | 0.05% | 0.05% | 0.05% |
| MeCl2/solvent% | 94.8% | 92.3% | 89.8% | 94.8% | 92.3% | 89.8% |
| MeOH/solvent% | 5.00% | 7.50% | 10.0% | 5.00% | 7.50% | 10.0% |
| water/solvent% | 0.24% | 0.24% | 0.24% | 0.24% | 0.24% | 0.24% |
| Uniquat mg/m2 | 1.20 | 1.20 | 1.20 | 1.20 | 1.20 | 1.20 |
| Solsperse mg/m$^2$ | 0.00 | 0.00 | 0.00 | 2.00 | 2.00 | 2.00 |
| | | | | | | |
| Floc rate (%T/hr x $10^4$) | 0 | 8 | 140 | 0 | 6 | 25 |
| | | | | | | |

Fig. 6

METHOD OF MANUFACTURE OF A POLYMERIC FILM WITH ANTI-BLOCKING PROPERTIES

CROSS-REFERENCE TO RELATED APPLICATIONS

The present application is a continuation-in-part of U.S. patent application Ser. No. 11/031,702, entitled "CELLULOSE FILM WITH ANTI-BLOCKING PROPERTIES," which was filed on Jan. 7, 2005, now abandoned and which is a continuation application of U.S. patent application Ser. No. 10/104,540, filed on Mar. 22, 2002 now abandoned. The present application claims priority under 35 U.S.C. § 120 from the above-captioned applications and the disclosures of the referenced applications are specifically incorporated herein by reference.

BACKGROUND

Polymeric films are useful in a variety of disparate technical applications. For example, polymer films are often used in display applications to provide a variety of optical functions to the display. One polymer material that is often incorporated as an optical film of a display device is triacetyl cellulose (TAC) film. Illustratively, TAC films may be used as polarizer protective layers in optical polarizers commonly used in liquid crystal displays (LCDs). The fundamental lack of TAC polymer orientation combined with the low stresses of solvent casting forms a unique polymer system for extremely isotropic LCD coversheets. These fundamental advantages have allowed solvent cast cellulose triacetate to capture the vast majority of LCD coversheet applications.

However, the TAC is a soft film and when produced and rolled for storage, or transportation, or both, the smooth front and back film surfaces have a tendency to stick or block together and generate poor wound roll quality which leads to defects in the LCD protective layers. In fact, similar films with smooth surfaces tend to 'block' or stick together when stacked or rolled. This is particularly troublesome when rolled substrates are stored at high temperatures and humidity.

Anti-blocking or slip agents have long been known to provide surface roughness to prevent adhesion between two sheets of what would otherwise be smooth film surfaces. The effect of roughening the surface is to reduce the frictional forces between the surfaces of sheets or layers of the substrate. Many inorganic and polymeric materials are known to act as good anti-blocking agents and various solutions to the problem have been proposed. Unfortunately, the surface roughness increase of the polymeric film via the anti-blocking agents is garnered at the expense of film haze or increased light scattering characteristics of the films.

Another source of optical degradation in optical films have anti-blocking agents is the anti-blocking agents themselves. To this end, the anti-blocking agents are often individual particles disposed in the polymeric film to provide the desirable surface roughness. However, if the size of the individual particles is in the realm of the wavelength of light, or if the individual particles flocculate and attain a size that approaches the wavelength of light, optical scattering occurs and the optical properties are deleteriously impacted.

In view of the foregoing, there exists a need to provide optical films having anti-blocking properties that overcome at least the shortcomings of known films described above.

SUMMARY

In accordance with an example embodiment, a method of fabricating a polymeric film includes adsorbing an ammonium salt surfactant over a plurality of polymer beads. The method also includes adding the polymer beads to a polymer solution, wherein the ammonium salt surfactant substantially prevents flocculation of the polymer beads.

In accordance with an example embodiment, a polymeric film includes a plurality of polymer beads each having an outer surface. The polymeric film also includes an ammonium salt surfactant disposed over each of the outer surfaces, wherein the ammonium salt surfactant substantially prevents flocculation of the polymer beads.

DETAILED DESCRIPTION

Definitions

The following terms are defined for purposes of describing the example embodiments.

Degree of crosslinking means the weight percentage of polyfunctional ethylenically unsaturated polymerizable monomers used to make the polymer.

Internal haze means the percentage of transmitted light that is scattered due to particles in the film without contribution from surface scattering effects.

Isotropic polymer means a polymer that exhibits substantially the same refractive index (within 0.02) in all directions.

One sided static friction coefficient means the static friction coefficient measured in the usual manner according to ASTM designation G143-96 obtained by measuring the friction coefficient between a film comprising a polymeric substrate having a surface bearing polymeric beads in contact with the same substrate in its uncoated form.

Transparent means that the transmitted light is 93% or greater.

Swell Ratio means the median bead diameter (based on volume distribution) measured in methylene chloride divided by the median diameter of the beads as made. Median diameter is defined as the statistical average of the measured particle size distribution on a volume basis. For further details concerning median diameter measurement, see T. Allen, "Particle Size Measurement", 4th Ed., Chapman and Hall, (1990).

Total haze means the percentage of transmitted light that is scattered due to a combination of surface irregularities and particles in the film.

Two sided static friction coefficient means the static friction coefficient measured in the usual manner according to ASTM designation G143-96 obtained by measuring the friction coefficient between two films comprising a polymeric substrate having a surface bearing polymeric beads.

BRIEF DESCRIPTION OF THE DRAWINGS

The example embodiments are best understood from the following detailed description when read with the accompanying drawing figures:

FIG. 6 is a tabular representation showing the flocculation rate for various conditions in accordance with an example embodiment.

DETAILED DESCRIPTION

Figures 1, 2:
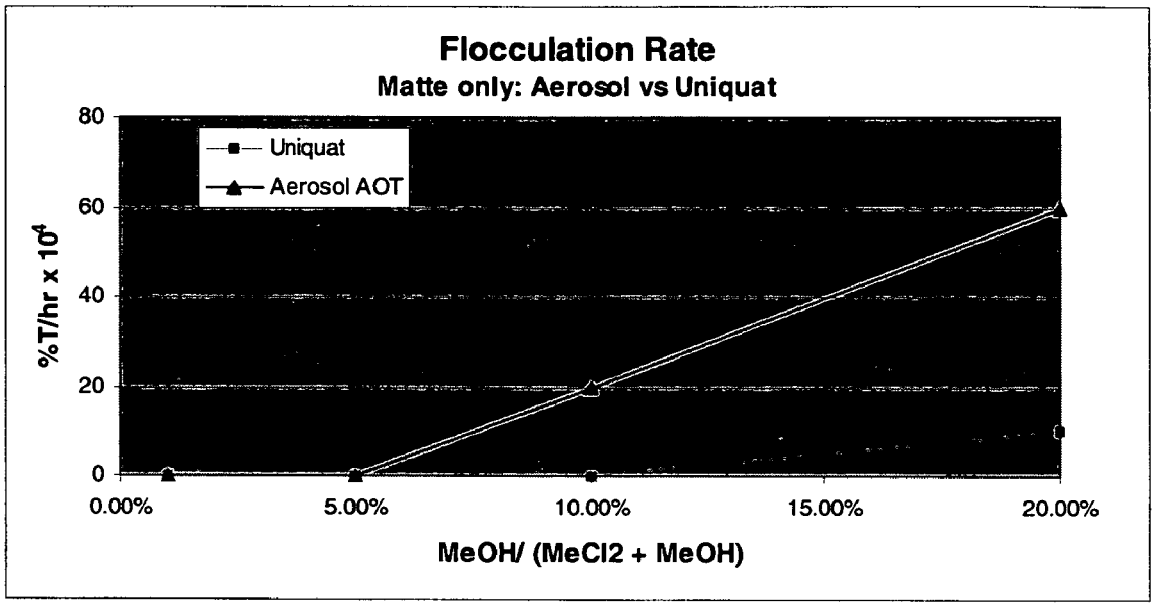
FIG. 1 is a graphical representation of the flocculation rate versus fraction of methanol in accordance with an example embodiment.
FIG. 2 is a tabular representation showing the flocculation rate for various conditions in accordance with an example embodiment.

In the following detailed description, for purposes of explanation and not limitation, example embodiments disclosing specific details are set forth in order to provide a thorough understanding of the present invention. However, it will be apparent to one having ordinary skill in the art having had the benefit of the present disclosure, that the present invention may be practiced in other embodiments that depart from the specific details disclosed herein. Moreover, descriptions of well-known apparati and methods may be omitted so as to not obscure the description of the example embodiments. Such methods and apparati are clearly within the contemplation of the inventors in carrying out the example embodiments.

The example embodiments relate to polymeric films, which have a useful combination of optical and slip properties. Desired optical properties include relatively low haze and good light transmittance making the polymeric films suitable for use in optical devices/applications. Of course, the referenced uses of the films are merely illustrative and it is emphasized that other uses of the films of the example embodiments are contemplated.

In accordance with an example embodiment, the substrate of the film may be nearly any transparent polymer such as polyesters and polyolefins. Illustratively, the substrate layer is triacetyl cellulose (TAC), a polymeric material in which all or a predominant portion of the film is cellulose triacetate. A variety of known sources or additives may be used in the film. The average acetyl value of the TAC polymer is in the range of approximately 50% to approximately 70%. In illustrative embodiments the range of TAC polymer is in the range of approximately 55% to approximately 65%. The weight average molecular weight beneficially is in the range of approximately 150,000 daltons (g/mole) to approximately 250,000 daltons and in certain example embodiments, the weight average molecular weight is approximately 180,000 daltons to approximately 220,000 daltons. The polydispersity index (weight average divided by number average molecular weight) of cellulose acetate is typically in the range of approximately 2 to approximately 7, especially approximately 2.5 to approximately 4.0. Cellulose acetate may be esterified using a fatty acid such as propionic acid or butyric acid, so long as the acetyl value satisfies the range. Otherwise, cellulose acetate may contain other cellulose esters such as cellulose propionate or cellulose butyrate so long as the acetyl value satisfies the range. The substrate film may contain a plasticizer or other additives.

Suitable polymeric beads useful as matting or anti-blocking agents in keeping with example embodiments include, but are not limited to: acrylic resins, styrenic resins, or cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, polyvinyl acetal, ethylene-vinyl acetate copolymers, ethylene-vinyl alcohol copolymers, and ethylene-allyl copolymers such as ethylene-allyl alcohol copolymers, ethylene-allyl acetone copolymers, ethylene-allyl benzene copolymers, ethylene-allyl ether copolymers, ethylene acrylic copolymers and polyoxy-methylene; polycondensation polymers, such as, polyesters, including polyethylene terephthalate, polybutylene terephthalate, polyurethanes and polycarbonates.

In an example embodiment, the polymeric beads are made from a styrenic or an acrylic monomer. Any suitable ethylenically unsaturated monomer or mixture of monomers may be used in making such styrenic or acrylic polymer. There may be used, for example, styrenic compounds, such as styrene, vinyl toluene, p-chlorostyrene, vinylbenzyl chloride or vinyl naphthalene; or acrylic compounds, such as methyl acrylate, ethyl acrylate, n-butyl acrylate, n-octyl acrylate, 2-chloroethyl acrylate, phenyl acrylate, methyl-α-chloroacrylate, methyl methacrylate, ethyl methacrylate, butyl methacrylate; and mixtures thereof. In another preferred embodiment, methyl methacrylate is used.

In addition, a suitable crosslinking monomer is used in forming the polymeric beads in order to produce the desired properties. Typical crosslinking monomers are aromatic divinyl compounds such as divinylbenzene, divinylnaphthalene or derivatives thereof; diethylene carboxylate esters and amides such as ethylene glycol dimethacrylate, diethylene glycol diacrylate, and other divinyl compounds such as divinyl sulfide or divinyl sulfone compounds. Divinylbenzene and ethylene glycol dimethacrylate are conveniently employed. The crosslinking monomer desirably represents at least 20 weight %, suitably at least 35%, and typically at least 50 weight % of the monomer mix. The degree of crosslinking is determined by the weight % of multifunctional crosslinking monomer incorporated into the polymeric beads.

The polymeric beads of the example embodiments can be prepared, for example, by pulverizing and classification of organic compounds; by emulsion, suspension, and dispersion polymerization of organic monomers; by spray drying of a solution containing organic compounds; or by a polymer suspension technique which consists of dissolving an organic material in a water immiscible solvent, dispersing the solution as fine liquid droplets in aqueous solution, and removing the solvent by evaporation or other suitable techniques. The bulk, emulsion, dispersion, and suspension polymerization procedures are well known to those skilled in the polymer art and are taught in such textbooks as G. Odian in "Principles of Polymerization", 2nd Ed. Wiley (1981), and W. P. Sorenson and T. W. Campbell in "Preparation Method of Polymer Chemistry", 2nd Ed, Wiley (1968).

The surface of the polymeric beads may be covered with a layer of colloidal inorganic particles as described in U.S. Pat. Nos. 5,288,598; 5,378,577; 5,563,226 and 5,750,378. The surface may also be covered with a layer of colloidal polymer latex particles as described in U.S. Pat. No. 5,279,934.

Illustratively, the polymer beads are fabricated by limited coalescence. To this end, after the pulverizing or milling to disperse the monomer droplets in aqueous suspension, surfactant is added to set the final size distribution of the monomer droplets during their growth via coalescence. The monomer droplet size stops growing once the available surface area is fully saturated with the added surfactant. The monomer droplet suspension is then heated to allow the bead polymerization to occur. Notably, the surfactant is beneficially adsorbed by the polymer beads.

In accordance with example embodiments, the surfactant is an ammonium salt. Illustratively, the ammonium salt is benzyl dimethyl tetradecyl ammonium chloride (CIN# 10082726, 50% active+10% EtOH+40% water), sold under the tradename Uniquat. As described more fully herein, after the fabrication of the polymer beads and their addition to the TAC solution, the surfactant usefully has a relatively low interfacial energy and provides a net charge on the surface of the polymer beads for electrostatic stabilization. Beneficially, this substantially prevents flocculation of the polymer beads and improved slip control, while not substantially affecting the optical characteristics of the film. It is noted that the ammonium salt surfactants of the example embodiments provide the referenced beneficial traits.

The polymeric beads used in accordance with example embodiments will usually have a median diameter of less than approximately 1.0 μm, typically from approximately 0.8 μm to approximately 1.2 μm. For further details concerning median diameter measurement, see T. Allen, "Particle Size Measurement", 4th Ed., Chapman and Hall, (1990).

The polymeric beads disposed over on a surface(s) of the substrate will be such that the swell ratio is less than 1.31. If the bead swells 31% or more in methylene chloride, then the resulting film does not exhibit the combination of surface slip and good optical properties that is required for defect free optical device applications.

The bead laydown is illustratively from 0.01 to 9.0 mg/m$^2$. When the median dry diameter of the beads is at least 0.5 μm, the typical laydown range is 0.01 mg/m$^2$ to 2.5 mg/m$^2$, or conveniently, 0.1 mg/m$^2$ to 1.5 mg/m$^2$. When the median dry diameter of the beads is less than 0.5 micrometers, the typical laydown range is 1 to 9 mg/m$^2$, or conveniently, 2 to 6 mg/m$^2$.

The illustrative embodiments also provide a method of forming a film having good surface slip/anti-blocking properties. The beads can be dispersed in a polymer solution designed to provide for good coating properties, but does not interfere with the functional performance of the film. Illustratively, the binder of the second layer is a cellulosic polymer.

In an example embodiment, the polymeric substrate layer is TAC, the matrix of the polymeric layer containing the beads is also TAC, and the film desirably exhibits a static surface friction of less than or equal to approximately 0.68 when tested against either itself or bare uncoated TAC film. In addition, the internal haze of the film must be less than approximately 0.1. It is also desired that the total haze be within a desirable range not more than approximately 0.90.

In an example embodiment, a method of applying the polymeric bead containing layer (also referred to as the second polymeric layer) onto the substrate layer consisting of TAC film comprises applying the beads suspended in an organic solvent. However, prior to application of the suspension, a hyperdispersant may be added. The hyperdispersant is illustratively Solsperse 32000 sold by Avecia; generally, the hyperdispersant of example embodiments is a polymeric amide.

In an example embodiment, the application of the polymeric beads to a TAC layer comprises casting the TAC layer and coating the TAC layer with the polymer matte bead suspension. Alternatively, the polymer layer coating can either be applied to a fully cured TAC film or 'in-line' during the curing process of a solvent cast TAC film. Methanol is conveniently included in the coating solution.

The surfactant and the hyperdispersant usefully prevent flocculation of the polymer beads during the coating process. To this end, the surfactant is adsorbed on the polymer beads when it is added to the final subbing mixture (TAC solution and the second polymer layer). Beneficially, the surfactant includes a hydrophobic end and a hydrophilic end. The hydrophobic end of the surfactant interacts with and is adsorbed by the surface of the polymer beads. The hydrophilic end of the surfactant includes the ammonium group, which extends into the solution of the TAC. The solution of the TAC is illustratively the TAC in a methylene chloride (MeCl2) and methanol (MeOH) solvent. Beneficially, the extension of the hydrophilic (polar) group into the solution electrostatically inhibits the interaction of other polymer beads with similar polar groups extending into the solution. Thereby, the surfactant ammonium salt provides an electrostatic barrier to polymer bead flocculation.

In addition to the benefits described, the ammonium salt surfactant provides substantially optimal dispersibility at approximately 5% MeOH to approximately 10% MeOH in the MeCl2/MeOH solvent mixture. In this way, the solvent mixture can be set at the azeotrope composition (7.5% MeOH) so that the casting layer does not show any solvent mixture shift with evaporation.

Beneficially, the hyperdispersant also provides stability to the polymer beads in solution, and substantially prevents flocculation as well. The hyperdispersant is a polymer that is adsorbed by the surfactant. The adsorption of the hyperdispersant again reduces the interfacial energy of the polymeric beads, but also prevents the polymer coils from interleaving. This entropy-driven phenomenon (steric stabilization) improves the stability of the polymeric beads and thus reduces the flocculation of the polymeric beads. Finally, it is noted that the use of the hyperdispersant is optional. In fact, significant improvements in flocculation have been garnered through the use of the surfactants of the example embodiments.

In accordance with one embodiment, an optical polarizer element comprises a polarizer having a polymeric film of an illustrative embodiment that is bonded by a known saponification/lamination technique well known to one of ordinary skill in the art. Among other uses the laminated polymeric film of this illustrative embodiment is a polarizer cover sheet. Thus, in accordance with one illustrative embodiment a polarizer cover sheet usefully protects the polarizer without significantly impacting the optical characteristics of the polarizer. As is well known, a liquid crystal imaging element comprising such a polarizer. An optical device of an example embodiment contains such a liquid crystal element.

The polymeric films of the example embodiments may be used in conjunction with a variety of LCDs, typical arrangements of which are described in the following. Liquid crystals (LC) are widely used for electronic displays. In these display systems, an LC layer is typically situated between a polarizer layer and an analyzer layer and has a director exhibiting an azimuthal twist through the layer with respect to the normal axis. The analyzer is oriented such that its absorbing axis is perpendicular to that of the polarizer. Incident light polarized by the polarizer passes through a liquid crystal cell and is affected by the molecular orientation in the liquid crystal, which can be altered by the application of a voltage across the cell. By employing this principle, the transmission of light from an external source, including ambient light, can be controlled. The energy required to achieve this control is generally much less than that required for the luminescent materials used in other display types such as cathode ray tubes. Accordingly, LC technology is used for a number of applications, including but not limited to digital watches, calculators, portable computers, electronic games for which light weight, low power consumption and long operating life are important features.

Another technique for improving wound roll quality that can be employed, which is particularly advantageous when used with wound rolls greater than 45 inches in diameter, is variably knurling the edges of the web as described in U.S. Pat. No. 5,393,589. The height or compressibility of the edge knurls is varied along the length of the web in a predetermined manner. One embodiment also provides a process for forming a wound roll of a polymeric film of an illustrative embodiment comprising passing the film through a processing cycle employing a variable knurl height.

EXAMPLES

The flocculation rate was measured for a TAC layer described in accordance with an example embodiment. A Turbiscan MA-2000 instrument is available from Formulaction (Toulouse, France) (www.formulaction.com, www.turbiscan.com) to facilitate the measurements. The reading head of the Turbiscan MA-2000 instrument measures the "transmitted" and "backscattered" light (850 nm wavelength or near-IR) intensity in 40 μm steps along a sample tube that is up to 80 mm long. This standard measurement is repeated at 2 hr intervals over 6-16 hrs (in the standard method) to record the sedimentation and clarification fronts for a given colloid suspension.

In an ideal suspension where the colloid is stable, the measured "transmitted" and "backscattered" traces show a fixed intensity along the mid-section of the sample tube as well as a clarification front movement at the top of the tube that is predicted by the following Stokes settling equation. This is the case for a water suspension of just the MmEd (50:50) polymer matte bead.

$$U = \frac{g d_p^2 \Delta\rho}{18\eta_{medium}}$$

Where:

g—acceleration due to gravity dp—particle diameter

Δρ—density difference between the particle and polymer solution $\eta_{medium}$—polymer solution viscosity However in the subbing suspension to be applied to the TAC sheet, the MmEd (50:50) polymer matte bead suspension shows hindered settling with no measured clarification front in the sample tube. The relative polymer bead stability in these suspensions is measured by the rate of change in the "transmitted" intensity along the mid-section of the sample tube.

The polymer beads form weak clusters that are easily redispersed with agitation and, in some cases, with just gentle shaking; this weak coupling is referred to as "flocculation" in the art. Since the beads have a median radius near or above the wavelength of the incident light ($R/\Lambda \approx > 1$), the "transmitted" intensity increases as the beads flocculate since their optical area falls inversely with effective size. This effect is well-described in the common light-scattering texts: M. Kerker, "The scattering of light and other electromagnetic radiation", Academic, NY 1969; C. F. Bohren and D. R. Hoffman, "Absorption and scattering of light by small particles", John Wiley and Sons, NY, 1983. The rate of increase in transmitted intensity thereby measures the bead flocculation rate.

FIGS. 1 and 2 show a comparison between a known surfactant (Aerosol AOT, CIN # 10006675) and the Uniquat surfactant (CIN# 10082726) of an example embodiment, in graphical and tabular form, respectively. The comparison is for a MmEd (50:50) polymer matte bead suspension in TAC solution as a MeCl2/MeOH solvent mixture series. (Standard Turbiscan MA-2000 measurement at 2 hour intervals over an initial 8 hour period at 25C.) The comparison set forth in FIGS. 1 and 2 considers the bead stability in a MeCl2/MeOH solvent mixture series without the presence of any possible adsorbed cellulose triacetate polymer. The ammonium salt surfactant (Uniquat) shows virtually no flocculation between approximately 1% MeOH solvent fraction and approximately 10% MeOH solvent fraction, while the sulfonate surfactant (Aerosol AOT) does not show any flocculation over a smaller MeOH solvent fraction range (1-5%).

Since the AOT Aerosol surfactant will reprotonate the polar sulfonate group to a more non-polar sulfonic acid, the ammonium salt of the example embodiments is a better dispersing surfactant for the higher MeOH solvent fractions. The more polar surfactant reduces the interfacial energy at the bead surface-solvent interface and also causes a charge repulsion between neighboring bead surfaces to provide electrostatic stabilization (as known in the art.)

Figure 3:
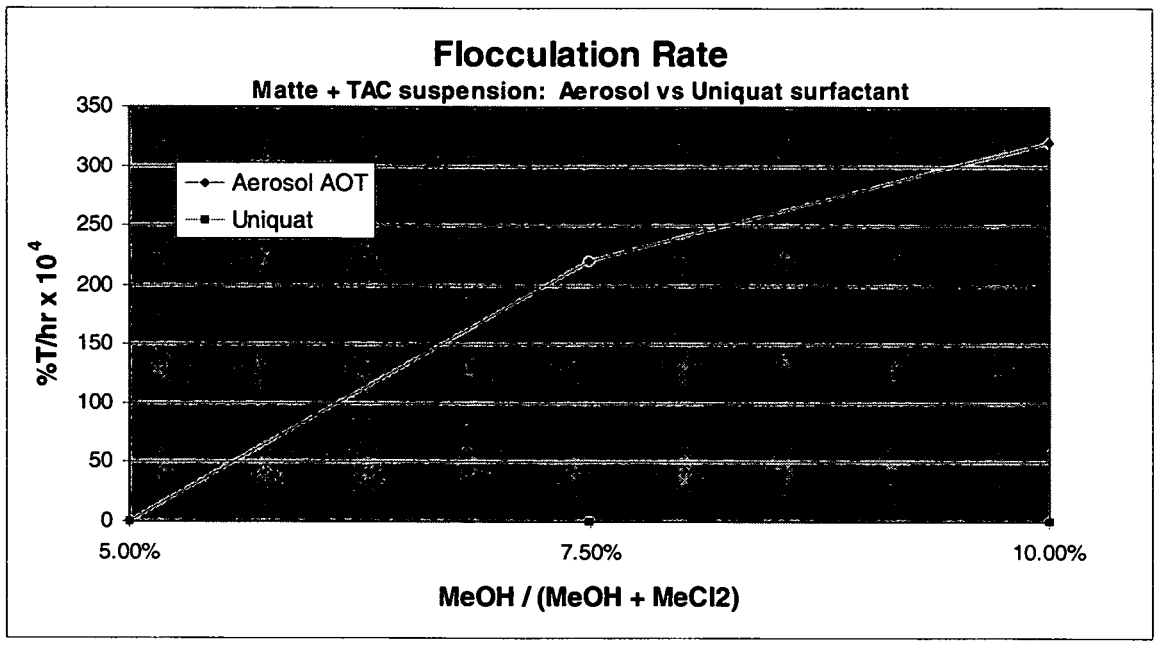
FIG. 3 is a graphical representation of the flocculation rate versus fraction of methanol in accordance with an example embodiment.
Figures 4, 5:
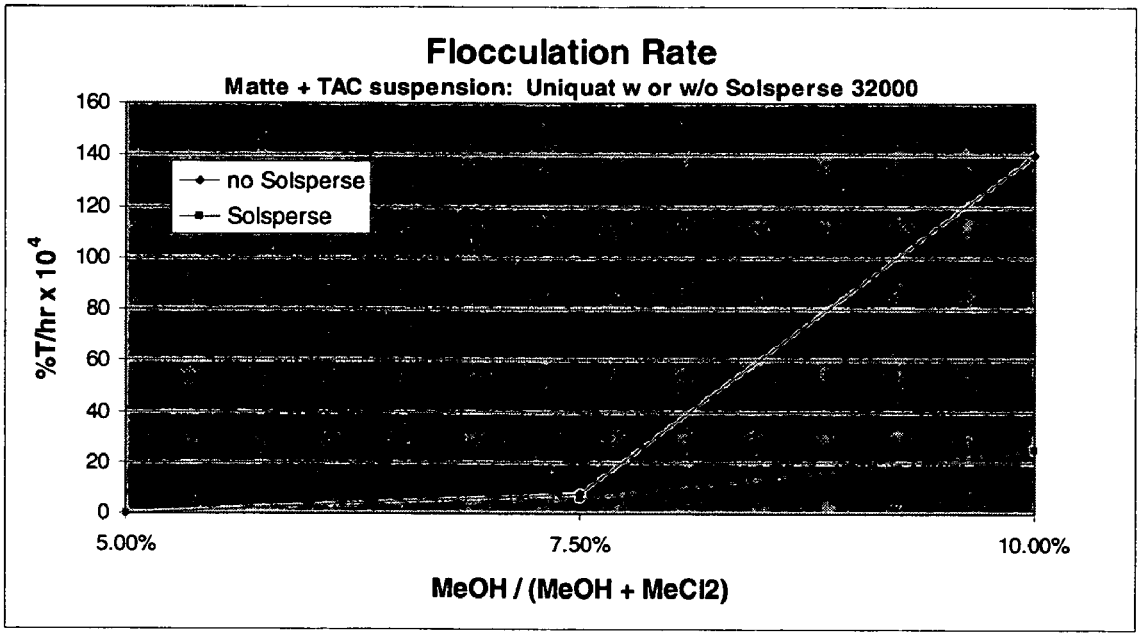
FIG. 4 is a tabular representation showing the flocculation rate for various conditions in accordance with an example embodiment.
FIG. 5 is a graphical representation of the flocculation rate versus fraction of methanol in accordance with an example embodiment.

FIGS. 3 and 4, in graphical and tabular form, respectively, show the Uniquat stabilized polymer matte suspended in a TAC polymer solution using different MeCl2/MeOH solvent mixtures; and the Aerosol AOT stabilized polymer matte suspended in a TAC polymer solution using different MeCl2/MeOH solvent mixtures. The comparison is for a MmEd (50:50) polymer matte bead suspension in TAC solution as a MeCl2/MeOH solvent mixture series. (Custom Turbiscan MA-2000 measurement at 2 hour intervals over an 8 hour period after an initial 16 hour hold at 25 C.) The comparison set forth in FIGS. 3 and 4 considers the bead stability in a MeCl2/MeOH solvent mixture series with the presence of any possible adsorbed cellulose triacetate polymer. The ammonium salt surfactant (Uniquat) does not show any flocculation between approximately 5% MEOH solvent fraction and approximately 10% MeOH solvent fraction, while the sulfonate surfactant (Aerosol AOT) does show significant flocculation above 5% MeOH solvent fraction.

Because the surfactant choice does affect the measured flocculation, the Cellulose Triacetate polymer does not significantly adsorb on the MmEd (50:50) bead surface and is not an effective dispersant by itself.

FIGS. 5 and 6 show a Uniquat-stabilized polymer matte suspended in a TAC polymer solution using different MeCl2/MeOH solvent mixtures with and without the addition of a hyperdispersant (e.g., Solsperse 32000). The graph (FIG. 5) and the table (FIG. 6) show the flocculation rate for a MmEd (50:50) polymer matte bead suspension in TAC solution as a MeCl2/MeOH solvent mixture series. (Custom Turbiscan MA-2000 measurement at 2 hour intervals over an 8 hour period after an initial 16 hour hold at 25 C.)

The bead stability for a cellulose triacetate polymer solution in a MeCl2/MeOH solvent mixture series is compared in FIGS. 5 and 6. In this case, a hyperdispersant (Solsperse 32000) is added to the suspension that also contains the ammonium salt surfactant (Uniquat).

To discriminate these very weakly-coupled flocculates, the suspensions are first kept in a static condition for 16 hrs before consecutive Turbiscan MA-2000 measurements at 2 hour intervals are made. In this way, the very weak coupling of the polymer beads in the Uniquat-only suspension is detected.

With the addition of a commercially available hyperdispersant (Solsperse 32000) to the final subbing layer, there is a significantly reduction in the formation rate of these weakly-coupled flocculates.

This hyperdispersant (polymeric amide) then adsorbs on the polymer bead surface and adds a steric stabilization. These polymeric hyperdispersants are generally added in an amount of 2 mg for every $m^2$ in available bead surface area.

In accordance with illustrative embodiments, a method of fabricating polymeric films with anti-blocking agents and the films are described. The films provide slip prevention and suitable optical properties. The various methods, materials, components and parameters are included by way of example only and not in any limiting sense. In view of this disclosure, those skilled in the art can implement the various example devices and methods to effect improved polymeric films, while remaining within the scope of the appended claims.

The invention claimed is:

1. A polymeric film, comprising:

a polymeric substrate layer and a surface layer wherein the surface layer comprises a plurality of polymer beads each having an outer surface wherein the polymer beads have a median diameter of approximately 0.8 μm to approximately 1.2 μm; and an ammonium salt surfactant disposed over each of the outer polymer bead surfaces, where the ammonium salt surfactant substantially prevents flocculation of the polymer beads.

2. A polymeric film as recited in claim 1, wherein the surface layer further comprises a hyperdispersent.

3. A polymeric film as recited in claim 1, wherein the hyperdispersent is a polymeric amide.

4. A polymeric film as recited in claim 1, wherein the polymeric film is a polarizer cover sheet.

5. A polymeric film as recited in claim 3, wherein the polymer beads have a diameter of approximately 1.0 μm.

6. The polymeric film of claim 1, wherein the polymeric substrate layer comprises triacetyl cellulose (TAC).

7. The polymeric film of claim 6, wherein the surface layer further comprises a polymer.

8. The polymeric film of claim 7, wherein the surface layer comprises triacetyl cellulose.

9. The polymeric film of claim 1, wherein the surface layer is coated utilizing a solvent selected from the group consisting of methanol, methylene chloride, and mixtures thereof.

10. The polymeric film of claim 1, wherein the polymer beads are useful matting or anti-blocking agents.

11. The polymeric film of claim 1, wherein the beads have a laydown of between 0.1 $mg/m^2$ and 1.5 $mg/m^2$.

* * * * *